US006855052B2

(12) United States Patent
Weiss et al.

(10) Patent No.: US 6,855,052 B2
(45) Date of Patent: Feb. 15, 2005

(54) GAMING DEVICE HAVING FIRST CHANCE MEANS AND SERIALLY DEPENDENT SECOND CHANCE MEANS

(75) Inventors: Steven A. Weiss, Las Vegas, NV (US); Jay Stone, Las Vegas, NV (US); Rex Carlson, Las Vegas, NV (US); Robert M. Dickenson, Las Vegas, NV (US)

(73) Assignee: Aristocrat Technologies Australia Pty Ltd., Las Vegas, NV (US)

( * ) Notice: Subject to any disclaimer, the term of this patent is extended or adjusted under 35 U.S.C. 154(b) by 13 days.

(21) Appl. No.: 09/921,076

(22) Filed: Aug. 2, 2001

(65) Prior Publication Data

US 2002/0193158 A1 Dec. 19, 2002

Related U.S. Application Data

(63) Continuation-in-part of application No. 08/950,280, filed on Oct. 14, 1997, now abandoned.

(51) Int. Cl.[7] ..... A63F 9/24
(52) U.S. Cl. ..... 463/16; 273/143 R
(58) Field of Search ..... 463/16, 17, 18, 463/19, 20, 21, 22, 25, 26, 27, 30, 31; 273/138.1, 142 R, 143 R, 142 B, 142 D, 141 R, 139

(56) References Cited

U.S. PATENT DOCUMENTS

| | | | |
|---|---|---|---|
| 4,624,459 A | 11/1986 | Kaufman | |
| 4,871,171 A | 10/1989 | Rivero | |
| 5,318,298 A | 6/1994 | Kelly et al. | |
| 5,342,049 A | 8/1994 | Wichinsky et al. | |
| 5,393,057 A | 2/1995 | Marnell, II | |
| 5,397,125 A | 3/1995 | Adams | |
| 5,409,225 A | 4/1995 | Kelly et al. | |
| 5,560,603 A | 10/1996 | Seelig et al. | |
| 5,788,573 A | 8/1998 | Baerlocher et al. | |
| 5,848,932 A | 12/1998 | Adams | |
| 5,947,820 A * | 9/1999 | Morro et al. | 463/9 |

FOREIGN PATENT DOCUMENTS

| | | |
|---|---|---|
| DE | 3630-714 A | 5/1988 |
| DE | 3801-643 A | 7/1989 |
| EP | 558307 A | 9/1993 |
| GB | 2 072 395 A | 9/1981 |
| GB | 2 083 936 A | 3/1982 |
| GB | 2 106 293 A | 4/1983 |
| GB | 2 137 392 A | 10/1984 |
| GB | 2 153 572 A | 8/1985 |
| GB | 2 170 636 A | 8/1986 |
| GB | 2 181 589 A | 4/1987 |
| GB | 2 191 030 A | 12/1987 |
| GB | 2 197 974 A | 6/1988 |
| GB | 2 202 984 A | 10/1988 |
| GB | 2 222 712 A | 3/1990 |
| GB | 2 226 907 A | 7/1990 |
| GB | 2 230 373 A | 10/1990 |
| GB | 2 273 384 A | 6/1994 |
| JP | 5 131044 | 5/1993 |

* cited by examiner

*Primary Examiner*—Kim Nguyen
(74) *Attorney, Agent, or Firm*—Bernhard Kreten

(57) ABSTRACT

A gaming device having a first chance opportunity and a second, serially dependent, chance opportunity is provided. The first chance opportunity is preferably a multiple reel game having a special outcome for triggering the second chance opportunity. The second chance opportunity is preferably a plurality of wheels rotatably coupled to a tower atop the reel game. The first of the wheels will spin and provide an outcome upon a specified outcome of the reel game. Each successive wheel will spin when a specified outcome is depicted on a previous wheel. This will continue until either the specified outcome does not occur or the last wheel is spun. In another version, plural wheels are each uniquely related—one to a given reel, such that a certain reel outcome will energize its associated wheel only. Multiple wheels, when synchronized to a certain outcome, lead to a bigger wheel for a jackpot.

14 Claims, 7 Drawing Sheets

GAMING DEVICE HAVING FIRST CHANCE MEANS AND SERIALLY DEPENDENT SECOND CHANCE MEANS

This application is a continuation-in-part of U.S. Ser. No. 08/950,280, filed Oct. 14, 1997, now abandoned.

FIELD OF THE INVENTION

This invention relates to gaming devices, especially those with a first chance means and a plurality of serially dependent second chance means.

BACKGROUND OF THE INVENTION

Gaming devices, such as slot machines, have been known to entertain players for some time. However, over time, such devices lose their novelty and hence their entertainment value for many players.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

U.S. Patents

| U.S. Pat. No. | ISSUE DATE | INVENTOR |
|---|---|---|
| 4,624,459 | Nov. 25, 1986 | Kaufman |
| 4,871,171 | Oct. 3, 1989 | Rivero |
| 5,318,298 | Jun. 7, 1994 | Kelly, et al. |
| 5,342,049 | Aug. 30, 1994 | Wichinsky, et al. |
| 5,393,057 | Feb. 28, 1995 | Marnell, II |
| 5,397,125 | Mar. 14, 1995 | Adams |
| 5,409,225 | Apr. 25, 1995 | Kelly, et al. |
| 5,560,603 | Oct. 1, 1996 | Seelig, et al. |

FOREIGN PATENTS

| PATENT NO. | PUBLICATION DATE | APPLICANT |
|---|---|---|
| GB 2,072,395 | Sep. 30, 1981 | Kennedy |
| GB 2,083,936 | Mar. 31, 1982 | Coin Operated Parts Service Ltd. |
| GB 2,106,293 | Apr. 7, 1983 | Summit Coin Ltd. |
| GB 2,137,392 | Oct. 3, 1984 | JPM (Automatic Machines) Ltd. |
| GB 2,153,572 | Aug. 2, 1985 | Arthur Edward Thomas Ltd. |
| GB 2,170,636 | Aug. 6, 1986 | JPM (Automatic Machines) Ltd. |
| GB 2,181,589 | Apr. 23, 1987 | Barcrest, Ltd. |
| GB 2,191,030 | Dec. 2, 1987 | Bell-Fruit Mfg. Co. Ltd. |
| DE 3,636,714 | May 5, 1988 | Gauselmann |
| GB 2,197,974 | Jun. 2, 1988 | Coinmaster Manufacturing Ltd. |
| GB 2,202,984 | Oct. 5, 1988 | Recreativos Franco S.A. |
| DE 3,801,643 | Jul. 27, 1989 | NSM-Apparatebau GmbH & Co. |
| GB 2,222,712 | Mar. 14, 1990 | Barcrest Ltd. |
| GB 2,226,907 | Jul. 11, 1990 | Bell-Fruit Mfg. Co. Ltd. |
| GB 2,230,373 | Oct. 17, 1990 | Bell-Fruit Mfg. Co. Ltd. |
| JP 5-131,044 | May 28, 1993 | Taiyo Jidoki K.K. |
| EP 0,558,307 | Sep. 1, 1993 | Arthur Edward Thomas Ltd. |
| GB 2,273,384 | Jun. 15, 1994 | JPM (Automatic Machines) Ltd. |

Japanese Patent No. 5-131044 to Taiyo Jidoki K. K. teaches a gaming device having a card game shown on a video monitor and a single wheel that is manually operable to depict an outcome. Although a single wheel is involved in this device, it is nothing like the invention presented in this application.

The other prior art listed above, but not specifically discussed, teach other devices for gaming machines and further catalog the prior art of which the applicant is aware. These references diverge even more starkly from the references specifically distinguished above.

SUMMARY OF THE INVENTION

In an ongoing effort to enhance the entertainment value of gaming devices, a spinning reel gaming device is provided with a plurality of spinnable wheels. When a player enables the reels spinning, in the event the reels stop in a "WIN" position as displayed, the player is credited with a win as expected. However, if instead, a special indicia such as "SPIN" appears, preferably on the third reel of the three reels, a first wheel on a protruding tower will spin. When that wheel completes its spin, two possibilities exist: first, if the outcome indicated is a numeral, then the player is credited with that amount; on the other hand, if the outcome is a special symbol, a next second, next, successive wheel spins, preferably, having higher award values posted. This process continues to a third wheel where, if the special symbol is the outcome, the player is awarded a maximum credit or "jackpot".

In a second variation according to the present invention, the multi reel first chance means each has a reel that is intimately associated with a respective one wheel of a multi wheel array. Thus, in a three reel primary game, the secondary wheel game includes three wheels, one per reel. Any of the multiple wheels is to be enabled upon the occurrence of a condition associated with it's designated reel. Thus, a three reel array has three wheels, reel one is linked to wheel one, reel two is linked to wheel two, and reel three is linked to wheel three. Generally, reel N is linked to wheel N. Reel N+1 is linked to wheel N+1, etc. Thus, should reel N have a certain outcome, it will enable it's corresponding wheel N. Thus, in the first example the wheels are serially dependent, in the present variation, one wheel is preferably inextricably linked to an associated reel such that there is one wheel per reel. Should all of the plural wheels be engaged by a certain set of outcomes on the associated reels, the three wheels will bestow upon the player an added bonus. In addition, if the three wheels each achieve a certain outcome, an additional bonus wheel will be activated pursuant to a special rule set.

The plurality of possibly spinning wheels combined with the reels enhances the entertainment value of the gaming device to a player. This is especially important in that a typical player need not learn any special instructions or strategies. The gaming device provides a more entertaining environment without such undue burden on the player, thus providing more entertainment value to the player.

OBJECTS OF THE INVENTION

It is a first object of the present invention to provide a gaming device having an outcome activated multi-wheel apparatus.

Viewed from a first vantage point, it is an object of the present invention to provide a gaming apparatus comprising, in combination, a wager input means, a game processor enabled by the wager input means, display means driven by the processor upon wager input, the display means including indicia defining an outcome, comparator means evaluating the outcome versus a paytable, and a plurality of wheel devices, serially enabled including an output bonus for each wheel device, and a first wheel device enabled by an outcome of the display means and each successive serially enabled wheel device is enabled only when a previous wheel displays a mandated outcome.

Viewed from a second vantage point, it is an object of the present invention to provide a method for entertaining with a multi-wheel gaming device, the steps including, inputting a wager, enabling a game, spinning a plurality of reels on a display by means of a computer processor, displaying an outcome on a display, comparing the outcome to a pay table, awarding a bonus credit when the outcome displayed on the reels is a winning outcome, spinning a first wheel when a first special symbol appears on the last of the reels, displaying an outcome on the first wheel, awarding a bonus credit when the outcome displayed is a number, spinning a second wheel when a second special symbol is indicated on the first wheel, awarding a bonus credit when the outcome displayed is a number, spinning a third wheel when the second special symbol is indicated on the second wheel, awarding a bonus credit when the outcome displayed on the third wheel is a number, and awarding a maximum bonus credit when the second special symbol is indicated on the third wheel.

Viewed from a third vantage point, it is an object of the present invention to provide a method for providing entertainment via a multi-wheel gaming device, the steps comprising, inputting a wager, enabling a processor, displaying an outcome, comparing the outcome to a paytable, serially enabling a plurality of wheel devices upon a mandated display outcome, and spinning each wheel, one at a time, only when a previous outcome is a mandated outcome recognized as qualifying for a serial wheel.

Viewed from a fourth vantage point, it is an object of the present invention to provide a method for providing entertainment via a multi-wheel gaming device, the steps comprising, allowing a wager, displaying a random outcome on a first display, enabling a series of second displays only as a function of a first display outcome, and allowing a second and subsequent series of second displays to be successively enabled only as a function of a previous qualifying outcome from and immediately preceding second display.

Viewed from a fifth vantage point, it is an object of the present invention to provide a gaming device having a multiple reel display having N individual reels, N wheels, one wheel per reel and an outcome of each said reel which enables its respective wheel.

Viewed from a sixth vantage point, it is an object of the present invention to provide a method for gaming, the steps including, receiving a wager, enabling N reels, and enabling a plurality of N wheels based on whether a said reel with which a said wheel is related has a specific output.

These and other objects will be made manifest when considering the following detailed specification when taken in conjunction with the appended drawing figures.

DESCRIPTION OF PREFERRED EMBODIMENTS

Figure 1:
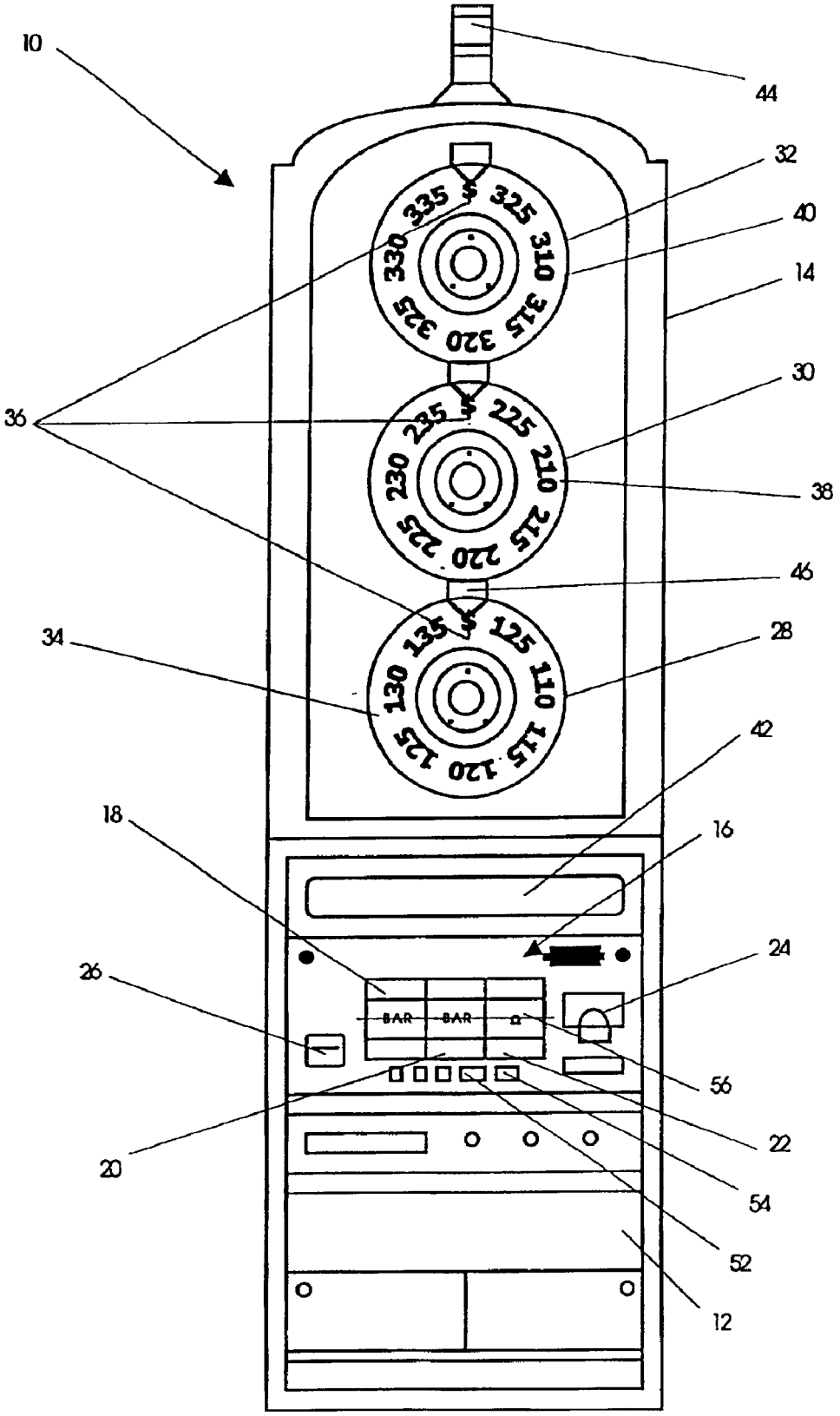
FIG. 1 is a front view of the invention.

Considering the drawings, wherein like reference numerals denote like parts throughout the various drawing figures, reference numeral 10 is directed to a gaming device having first chance means and serially dependent second chance means according to a first embodiment of the present invention. The gaming device is made up of two main components: a lower slant-top pedestal base 12 and an upper wheel tower 14.

Figure 2:
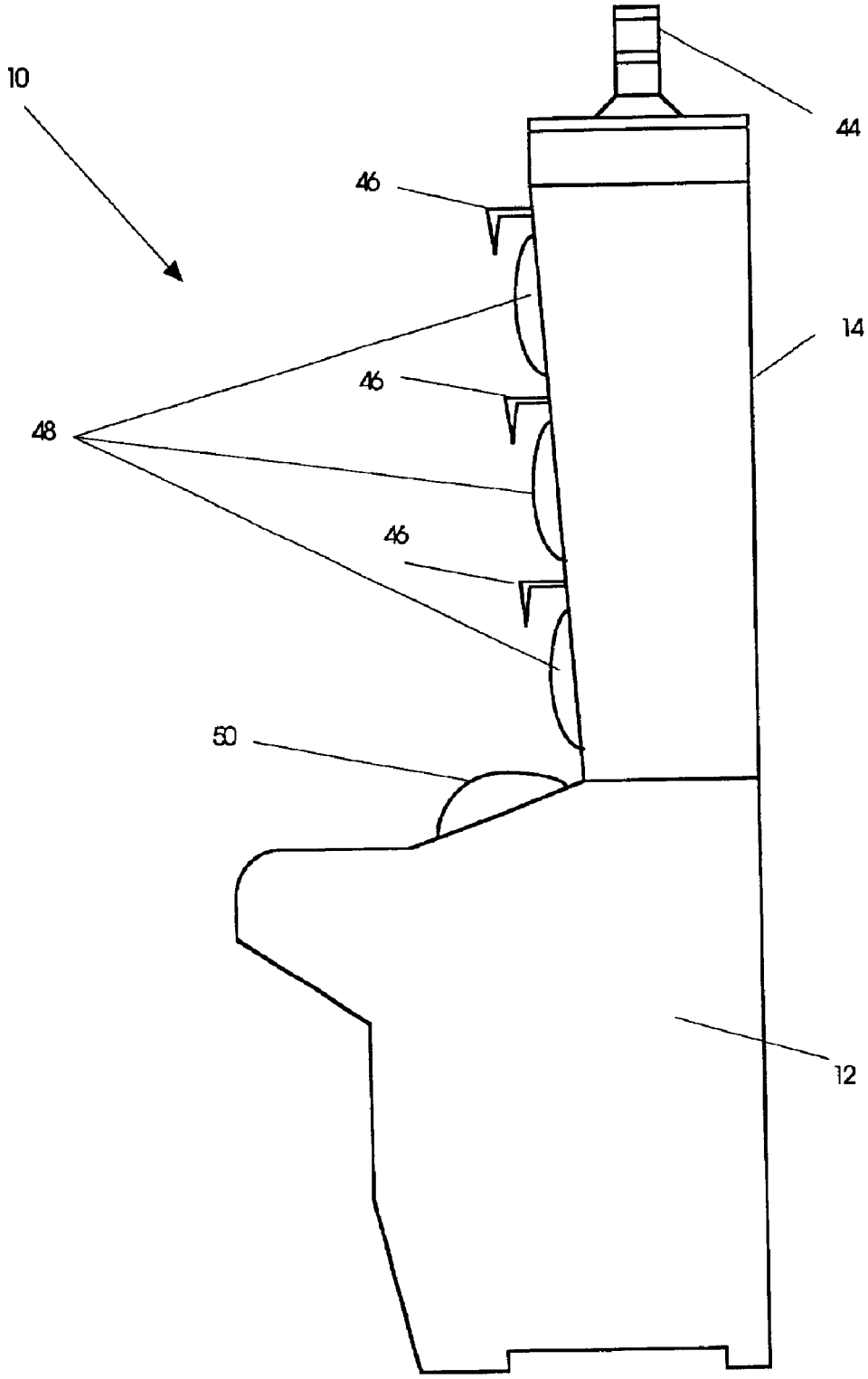
FIG. 2 is a right side view of the invention.
Figure 3:
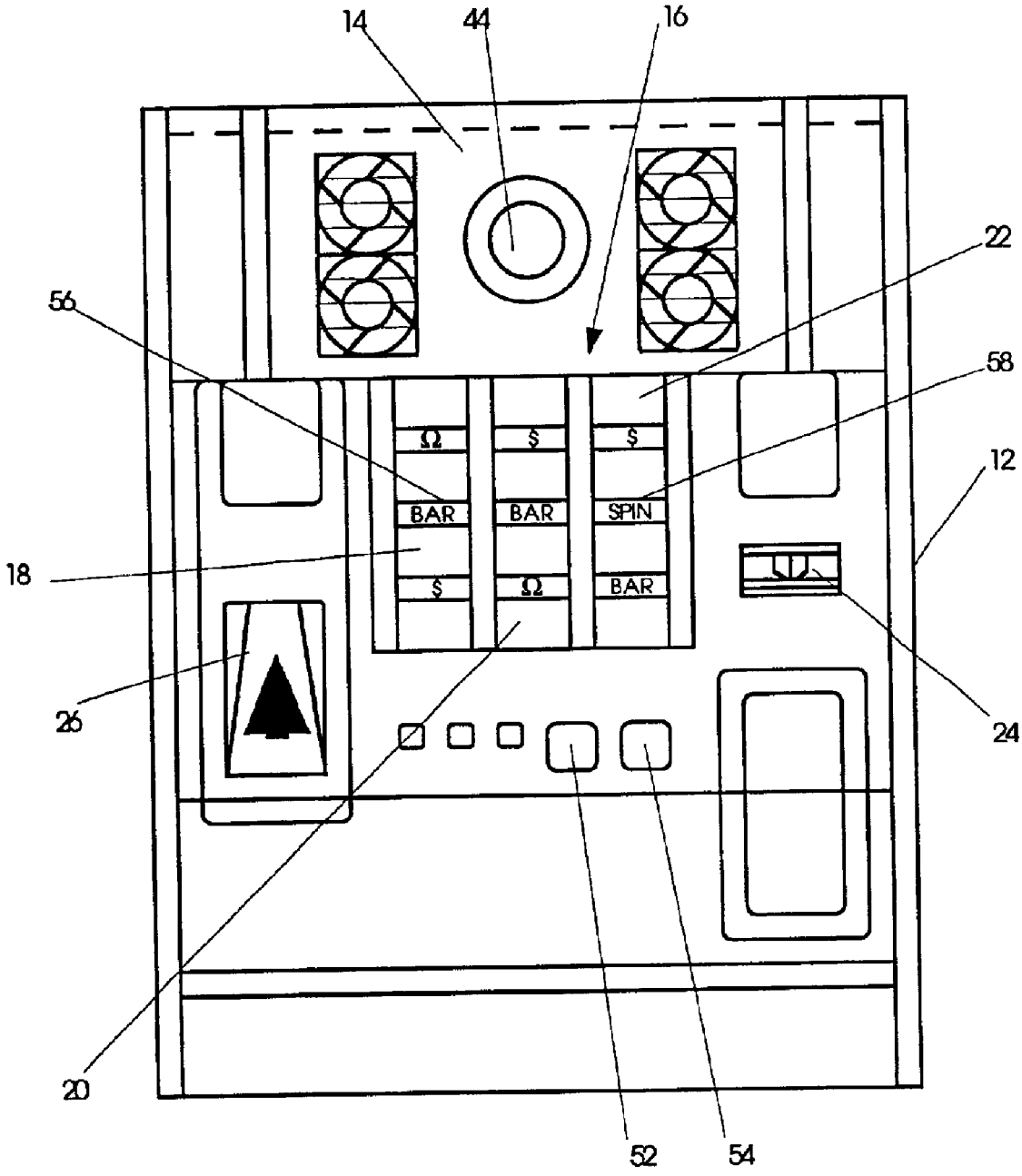
FIG. 3 is a top view of the invention.
Figure 5:
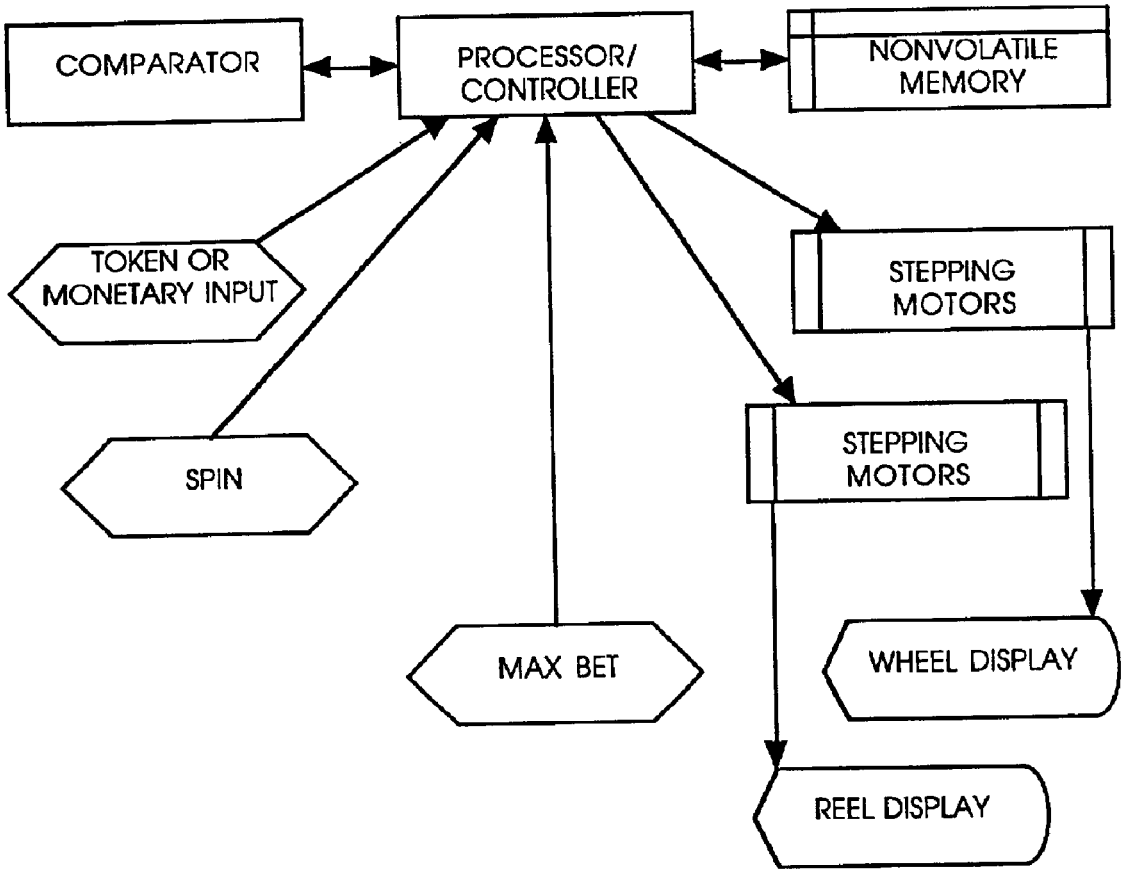
FIG. 5 is a schematic diagram of the invention.

As seen in FIGS. 1 through 3, a lower slant-top pedestal base 12 includes monetary input means for coins or tokens 24 or cash or cards 26. The base also includes means for actuating reels 16, the means including a reel spin button 52 which enables reels 16 to so spin. Other means, such as a handle arm, could also be used of course. Included with this gaming device are three reels 16, reel one 18, reel two 20 and reel three 22, each attached preferably to a stepping motor 62 (see FIG. 5). As is typical, each reel 18, 20, 22 has indicia 56 thereon to so depict an outcome according to reel alignment upon cessation of reels 18, 20, 22 spinning. Of course, more reels could be involved. Special indicia, such as the "SPIN" symbol 58 depicted on the third reel 22, are specially provided.

The tower portion 14, on the other hand, supports three wheels 28, 30, 32, each rotatably attached to its own respective stepping motor 60. Indicia 34, 38, 40 are presented upon each wheel as well, along with another special symbol 36. A pointing device 46 is provided for indicating an outcome to a player. Fans (not shown) may provide a cooling source for the invention.

Figure 4:
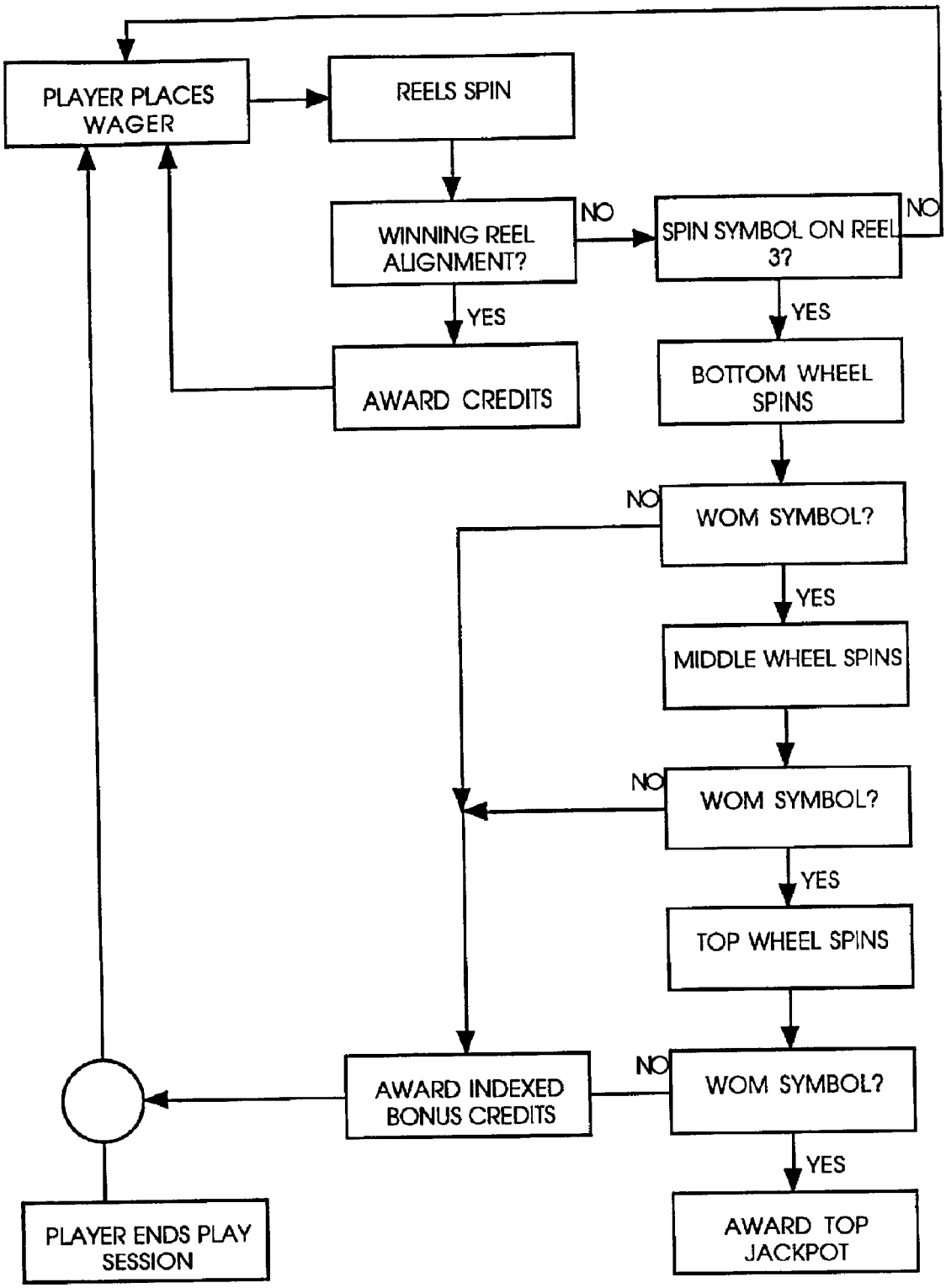
FIG. 4 is a flow chart of one possible gaming process of the invention.

In use and operation, as depicted in the flow diagram of FIG. 4, a player inserts a coin or token into slot 24 or cash or playcard into receptacle 26. Thereafter, the player may choose to press the "MAX BET" button 54 to maximize potential credit outcomes of the game. By next pressing the "SPIN" button 52, the reels 18, 20, 22 are started spinning. This is accomplished by a processor 64 within the gaming device 10 coupled to the "SPIN" button 52. The processor 64, programmed for this gaming device, then stops the reels 18, 20, 22 by means of stepping motors 62 as indicated above and displays an outcome as depicted by indicia 56.

If the indicia 56 provide a winning outcome determined by the game program and operation of processor 64 and comparator 66, as may be depicted on game instruction area 42 (commonly known as a player pay table), the player is credited with an appropriate credit. If a "SPIN" symbol appears on at least one reel, preferably reel three 22, the processor starts wheel one 28 spinning. At an appropriate moment that first wheel 28 is then stopped by processor 64 via stepping motor 60, displaying an outcome as indicated by pointer 46 vis-à-vis the indicia therein beneath. If the indicia 34 is a number, then that amount is credited to the player. If the pointer 46 indicates the special symbol 36, then the second wheel 30 starts spinning as accomplished again by the gaming program, processor 64 and comparator 66. When the second wheel 30 stops spinning, the outcome is again displayed on that wheel beneath pointer 46. Again, if the indicia is numeric, that amount is credited to the player. If the special symbol 36 is indicated, the third wheel 32 is started spinning, not unlike above. The same results are delineated for the third wheel 32 except if the special symbol 36 is depicted on the third wheel 32, the player receives a maximum award or "jackpot" and tower light 44 is activated. Certainly, the entertainment value of this game could be further enhanced by providing greater numeric indicia on each wheel as the next successive wheel in order as portrayed in FIG. 1.

Figure 6:
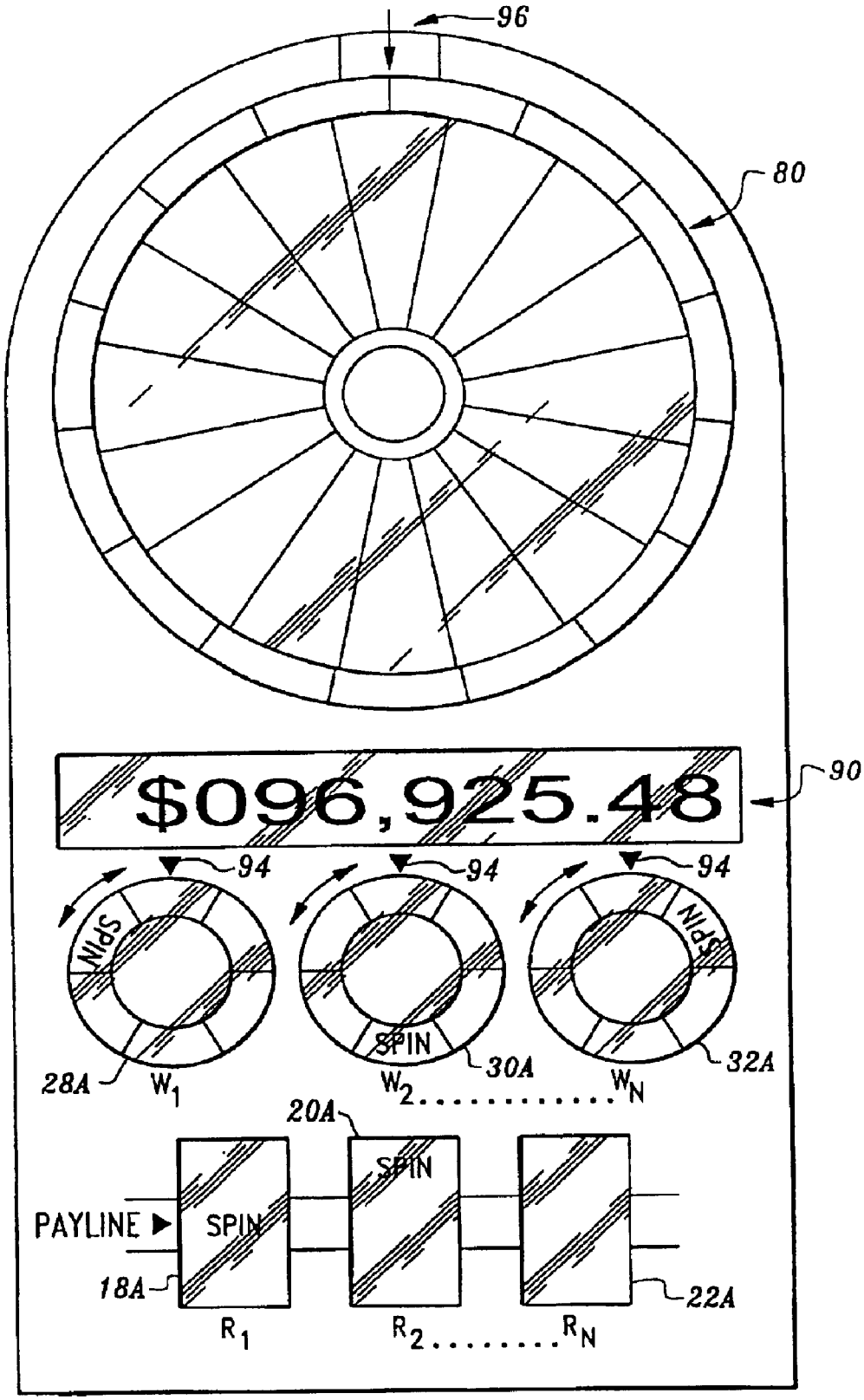
FIG. 6 is a front view, similar to FIG. 1 of a second version of the invention.
Figure 7:
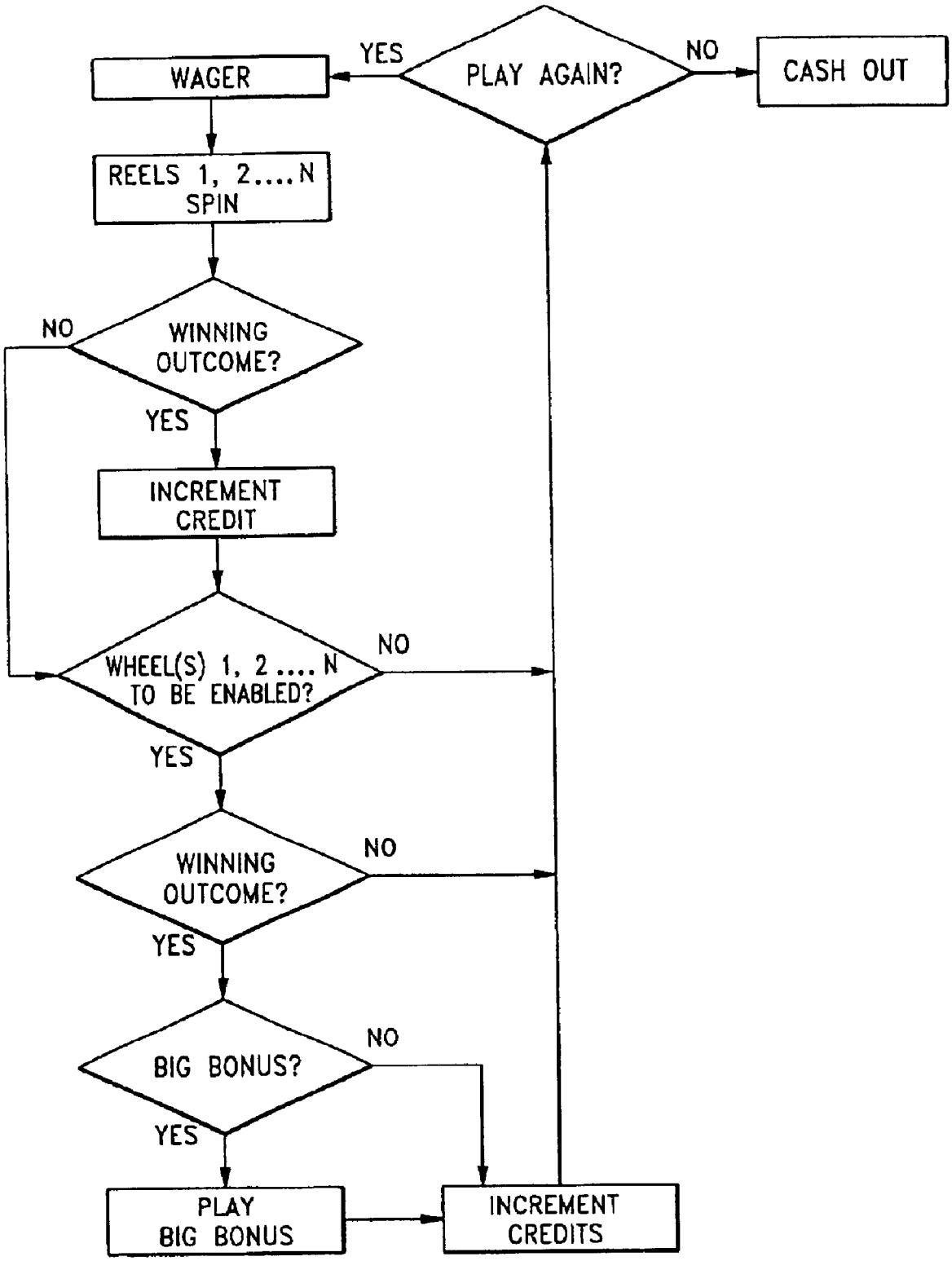
FIG. 7 is a second flow chart for use for example with the second version.

Referring to FIGS. 6 and 7, a second form of the invention is to be elaborated, with only those salient differences being discussed. The areas of commonality shall not be belabored so as to not further burden or occlude the understanding of the present invention.

A plurality of reels $R_1$, $R_2$, $R_3$, . . . $R_N$ is shown in FIG. 6, with a first reel labeled 18 A, a second reel 20 A and a third reel 22 A. It is preferred that the player play the maximum number of coins or the maximum wager in order to enable all features of the present invention. Assume, as shown in FIG. 6 that at least one "spin" symbol appears on the central payline shown in FIG. 6. In the present example, because the first reel enjoys the benefit of the word "spin" on the payline, then the first wheel $W_1$ located directly above reel 1 will rotate in the direction of the double ended arrow shown in FIG. 6. Had reel 2 also had its "spin" symbol located on a payline, wheel $W_2$ would have also spun about the direction of the arrow shown immediately adjacent thereto. Similarly, had reel $R_N$ exposed a "spin" nomenclature on a payline, wheel $W_N$ would have similarly been enabled. The three wheels shown are immediately correlated, each to the lower adjacent reels. Thus, there is one wheel per reel and any one reel can motivate its associated wheel upon the existence of certain indicia, for example "spin". As shown, the three wheels, W1, W2 . . . $W_N$ bear reference numerals 28A, 30A and 32A respectively.

Directly above the wheels, a display 90 in the form of a cash odometer is shown should the machine be coupled to a progressive system in which a plurality of wagers received from comparable machines have a portion of each wager sequestered into a pool for a communal opportunity from the multiple players to winning the amount posted on the odometer 90.

Assume that each of the wheels W1, W2 . . . $W_N$ all have been enabled such that the respective pointers 94 located above each wheel is pointing towards the "spin" word. In such an event, these many wheels 28A,–32A enable a "big" wheel 80 which is subsequently spun a multiplicity of times as enabled by an illuminated spin button located on the console, similar to any of the buttons 52, 54 shown in FIG. 1. While that spin button has been eliminated, the big wheel 80 will rotate and indicator 96 will reflect the final position of the big wheel 80. Instead of illumination, a spin message may appear on a message screen integrated in the reel structure. Typically, the big wheel will consist of 16 segments. The segments will be marked as "pass, fifty, collect/half, 100, pass, 40, collect, 10, pass, 30, collect/double, 100, pass, 20, collect, and 10". Upon the occurrence of the word "collect", preferably, the amount of money displayed on the odometer 90 will be endowed to the player. Conversely, collect/half reduces that sum whereas collect/double will double the sum posted. The other numbers will reflect a cash value for the player who has reached the bonus round. This bonus round enabling the big wheel 80 is preferably only available by having all "spins" oriented with respect to pointer 94 on all of the wheels. Anything less than all of the wheels 28, 30, 32, etc. showing the word "spin", will allow the player to increase the amount of credits by the face value posted on wheels $W_1$, $W_2$, . . . $W_N$. Typically these smaller wheels will have credits that bear the numerals 25, 50, 100, etc. on remaining sections not having the spin symbols.

Moreover, having thus described the invention, it should be apparent that numerous structural modifications and adaptations may be resorted to without departing from the scope and fair meaning of the instant invention as set forth hereinabove and as described hereinbelow by the claims.

We claim:

1. A gaming device, comprising, in combination:

a wager input means;

a processor enabled by said wager input means;

a multiple reel display having N individual reels, a multiple wheel display having N wheels, means for coupling one wheel per reel such that at least one outcome for each said reel will enables its respective wheel.

2. The device of claim 1 wherein said respective wheel of said reel is enabled only by one outcome and said wheel remains inoperative otherwise.

3. The device of claim 1 further comprising comparator means for assessing outcomes on said N wheels including means to enable a further award based upon at least one outcome on said N wheels.

4. The device of claim 3 wherein said further award includes an odometer type display showing a face value of a present, potential payout and said further award includes means to bestow either said face value, a multiplier of said face value or an unrelated amount, whereby said means to bestow either said face value, a multiplier of said face value or an unrelated amount adjusts a potential amount to be awarded a player.

5. The device of claim 4 wherein said multiplier is an integer.

6. The device of claim 5 wherein said integer doubles said face value.

7. The device of claim 4 wherein said multiplier is a fraction.

8. The device of claim 7 wherein said fraction halves said face value.

9. The device of claim 4 wherein said further award includes a wheel larger than said N wheels and disposed above said N wheels, said N wheels disposed above said N reels in substantial vertical alignment.

10. A method for gaming, the steps including:

receiving a wager;

enabling N reels;

coupling one wheel of a plurality of N wheels per reel of said reels; and enabling a wheel of said plurality of N wheels based only on whether a reel of said N reels with which said wheel is related has a specific output.

11. The method of claim 10 further including comparing an outcome exhibited on said N wheels, and enabling a further award based on one specific outcome being exhibited.

12. The method of claim 11 further including enabling chance means upon the occurrence of the one specific outcome to determine the further award.

13. The method of claim 12 further including displaying a prize available as the further award and bestowing to a player an award of the prize after modifying the prize upon executing the chance means.

14. The method of claim 13 including multiplying the prize by a number where the number is either an integer or a fraction.

* * * * *